US007077498B2

(12) United States Patent
Nagase

(10) Patent No.: US 7,077,498 B2
(45) Date of Patent: Jul. 18, 2006

(54) LIQUID EJECTING APPARATUS

(75) Inventor: Makoto Nagase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 10/665,732

(22) Filed: Sep. 22, 2003

(65) Prior Publication Data

US 2004/0130589 A1 Jul. 8, 2004

(30) Foreign Application Priority Data

Sep. 20, 2002 (JP) ..... P.2002-274991

(51) Int. Cl.
*B41J 2/165* (2006.01)

(52) U.S. Cl. ..... 347/33

(58) Field of Classification Search ..... 347/22, 347/24, 28, 29, 30, 33
See application file for complete search history.

(56) References Cited

U.S. PATENT DOCUMENTS 5,706,038 A * 1/1998 Jackson et al. ..... 347/33
6,109,726 A * 8/2000 Lee ..... 347/33

FOREIGN PATENT DOCUMENTS

| | | | |
|---|---|---|---|
| JP | 04-371850 | A | 12/1992 |
| JP | 07-256887 | | 10/1995 |
| JP | 8-207292 | A | 8/1996 |
| JP | 10-235883 | A | 9/1998 |
| JP | 10-247048 | A | 9/1998 |
| JP | 2001-334676 | A | 12/2001 |
| JP | 2002-072828 | A | 3/2002 |

* cited by examiner

*Primary Examiner*—Shih-Wen Hsieh
(74) *Attorney, Agent, or Firm*—Sughrue Mion, PLLC

(57) ABSTRACT

A liquid ejecting apparatus, includes a carriage reciprocating, a liquid ejecting head mounted on the carriage and having a nozzle forming face from which liquid is ejected, and wiping member wiping the nozzle forming face of the liquid ejecting head in accordance with a movement of the carriage. The wiping member includes a body part, a wiping part formed in a tip of the body part for abutting the liquid ejecting head and a support part supporting the body part.

16 Claims, 5 Drawing Sheets

LIQUID EJECTING APPARATUS

BACKGROUND OF THE INVENTION

This invention relates to a liquid ejecting apparatus including wiping member for wiping the nozzle opening formation face of a liquid ejecting head.

An ink jet printer is available as a liquid ejecting apparatus for supplying liquid stored in liquid storage member to a liquid ejecting head, and ejecting the liquid to a target from openings of a nozzle formed in the liquid ejecting head. This kind of printer includes a record head formed with a plurality of nozzles each having minute openings and ejects ink droplets from the openings of each nozzle. The ejected ink remains in the vicinities of the openings at the ejecting time or is deposited on the opening formation face of the record head because it bounces off a record medium such as paper or for any other reason. The deposited ink may be mixed with a different type of ink, may deviate the ink droplet ejection direction, or may cause nozzle clogging, to occur etc. Thus, the ink jet printer is provided with a wiping mechanism as wiping member for wiping the opening formation face of the record head. The wiping mechanism generally is formed of a material having flexibility such as an elastomer. When the wiping mechanism abuts the record head, the record head on a moving carriage abuts the wiping mechanism with standing still. Alternatively, the wiping mechanism itself moving, abuts the record head with standing still. While the wiping mechanism is deformed by abutting the record head, the wiping mechanism slides on the opening formation face of the record head for wiping ink deposited on the openings and their surroundings. The wiping mechanism then removes excessive ink and adjusts the ink meniscus at the nozzle tip.

When such a wiping mechanism abuts the record head, it needs to come in intimate contact with the record head at a comparative large pressure. Thus, the wiping mechanism requires adhesion properties to the opening formation face, namely, high flexibility and a high elastic coefficient for producing pressure for pressing the abutment face on the record head against the record head. However, to form the wiping mechanism of one member, it is difficult to satisfy the characteristics of both the adhesion properties and the elastic coefficient. Thus, a wiping mechanism formed using a plurality of members in combination is proposed. A wiping mechanism including a core and a surface layer covering the core for wiping the opening formation face of a record head with the surface layer is proposed. The core is made of urethane foam, etc., having water retentivity. The surface layer is made of a fiber material having water absorption properties. (For example, refer to JP-A-8-207292 (columns 3–6, FIG. 1)) Also other wiping mechanism is proposed that the wiping mechanism formed using materials different in elastic coefficient in combination for wiping the opening formation face of a record head with the member made of the material having the smaller elastic coefficient. (For example, refer to JP-A-2001-334676 (columns 5–14))

The wiping mechanism having the core formed with the surface layer made of a fiber material is excellent in the flexibility of the surface layer; however, when the water retention amounts of the surface layer and the core reach saturation levels, it is feared that the opening formation face of the record head may be contaminated by the absorbed ink. In a case of using pigment ink, there are possibilities of not only incompletely wiping the pigment deposited on the opening formation face of the record head, but also contaminating the nozzle openings, etc., by the pigment remaining on the fibrous surface layer.

As for the wiping mechanism formed of materials different in elastic coefficient, the wiping face abutting the record head is made of the material having the lower elastic coefficient, and the member made of the material having the larger elastic coefficient is placed near to the wiping face. Thus, the wiping face of the wiping mechanism becomes flat without becoming deformed like retroflexion, sinkage, etc. Therefore, it is possible to abut all area of the wiping face against the opening formation face at a smaller pressure as compared with a wiping face having irregularities. On the other hand, the wiping mechanism includes the member made of the material having the larger elastic coefficient at a deformed place below the wiping face and thus an inflection point occurs in the elastic coefficient from the bottom to the wiping face. Thus, when warpage occurs at the wiping time, there is a possibility that force will concentrate on the vicinity of the inflection point, producing deformation of bend, etc. The member made of the material having the larger elastic coefficient is inserted into the vicinity of the wiping part having the wiping face, is laid up on the wiping part, or is formed like waves and therefore parts manufacturing becomes complicated at expense in time and effort with an increase in cost.

SUMMARY OF THE INVENTION

It is therefore an object of the present invention to provide a liquid ejecting apparatus including wiping member having a wiping part for wiping a liquid ejecting head, wherein the wiping part can be abutted against the liquid ejecting head at a comparatively large press pressure while flexibility is maintained in a simple structure and deformation of and damage to the wiping part can be prevented as much as possible.

In order to achieve the above object, according to the present invention, there is provided a liquid ejecting apparatus, comprising:

a carriage, reciprocating;

a liquid ejecting head, mounted on the carriage, and having a nozzle forming face from which liquid is ejected; and a wiping member, wiping the nozzle forming face in accordance with a movement of the carriage, wherein the wiping member includes:

a body part;

a wiping part, formed at a tip of the body part for abutting the liquid ejecting head; and a support part, supporting the body part.

In the above configuration, when the wiping part uses a material having flexibility, the wiping part is supported by the support part and therefore can be abutted against the liquid ejecting head at a comparatively strong press pressure. Therefore, the liquid deposited on the opening formation face can be wiped clean. Since the support part supports the body part of the wiping part, deformation of and damage to the wiping part can be prevented as much as possible.

Preferably, the support part is formed so that a sectional area of the support part parallel with a bottom face of the support part becomes smaller toward the tip from the bottom face.

In the above configuration, the lower part of the support part has a large elastic coefficient and the elastic coefficient decreases gradually toward to the upper part. Accordingly, when the wiping part bends and gives press pressure to the support part, the stress from the upper part of the support part can be decreased and the stress from the lower part of the support part can be increased. Since the wiping part is supported by the described support part, the pressure for pressing the upper part of the wiping part against the liquid ejecting head can be increased while the adhesion properties to the liquid ejecting head, namely, flexibility is maintained.

Preferably, the support part is provided on a side face of the wiping part.

In the above configuration, the flexibility of the shape of the wiping part can be enhanced.

Here, it is preferable that, the side face of the wiping part is a face opposite to the face which the liquid ejecting head abuts.

In the above configuration, when the wiping member abuts the liquid ejecting head, the wiping part is supported by the support part from the face opposite to the abutment face, so that the body part can be supported more effectively.

Preferably, the support part is provided in the wiping part.

In the above configuration, the wiping part can be supported by the support part from the inside of the wiping part, and the wiping member can be miniaturized.

Preferably, the support part has an elastic coefficient larger than that of the wiping part.

In the above configuration, the wiping part can be pressed against the nozzle formation face of the liquid ejecting head at a larger press pressure.

Preferably, the support part has the same elastic coefficient as that of the wiping part.

In the above configuration, manufacturing is facilitated and the cost can be reduced.

Preferably, the support part has a cone shape.

Preferably, the support part has a pyramid shape.

In the above configurations, the stress from the upper part in the support part can be decreased and the stress from the lower part can be increased according to the simple structures.

Preferably, the support part has a triangular pole shape.

In the above configuration, the number of support parts is changed, whereby the magnitude of the pressure at which the wiping part abuts the liquid ejecting head when the wiping part abuts the liquid ejecting head can be set to any desired magnitude.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

First Embodiment

A first embodiment of the invention will be discussed with reference to FIGS. 1 to 4.

Figure 1:
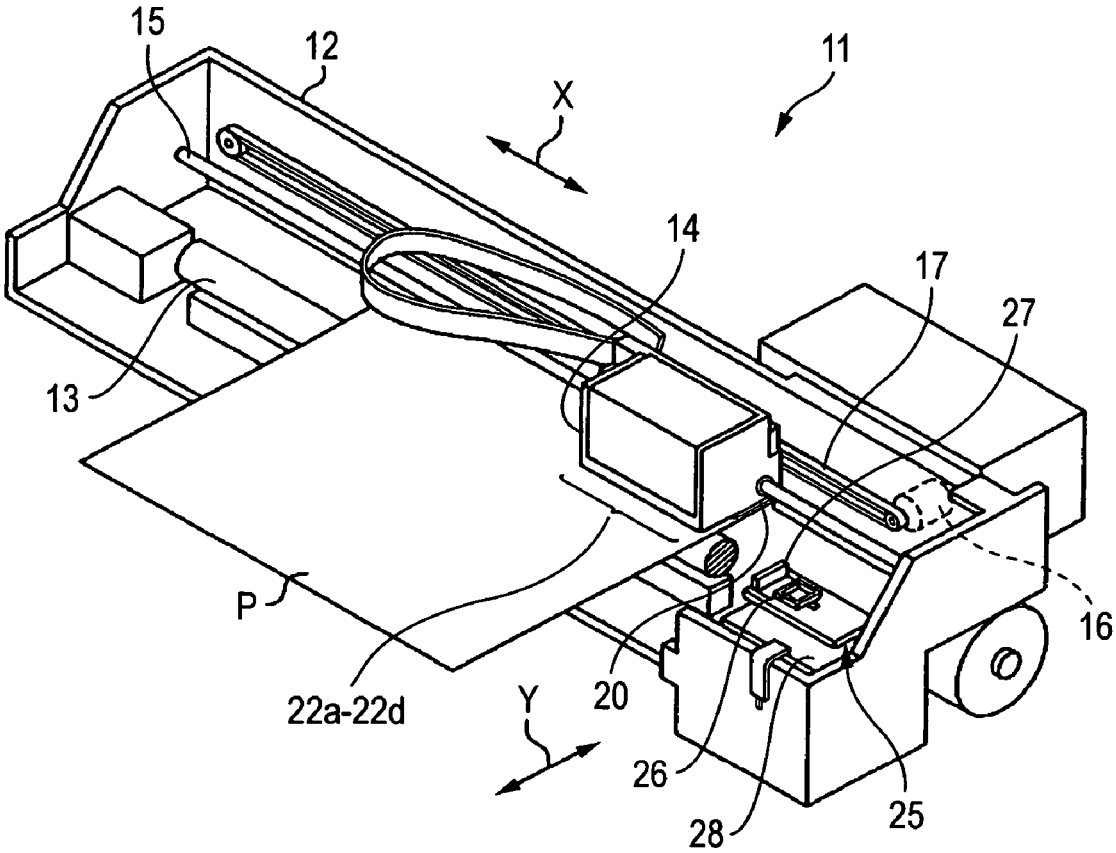
FIG. 1 is a perspective view of an ink jet printer main unit according to a first embodiment of the invention.

An ink jet printer as a liquid ejecting apparatus has a printer main unit 11 in a case (not shown) as shown in FIG. 1. The printer main unit 11 includes a frame 12 provided with a platen 13, and supplies a record medium P as a target onto the platen 13 by a paper supplying mechanism (not shown). In the printer main unit 11, a carriage 14 is movably supported through a guide member 15 and is reciprocated in an X direction (horizontal direction) through a timing belt 17 by a carriage motor 16.

A record head 20 as a liquid ejecting head is mounted on the lower side of the carriage 14. The record head 20 has a plurality of nozzles and includes a nozzle plate section 21 as a nozzle formation face (see FIGS. 3 and 4) formed with nozzle openings on the lower face. From the nozzle openings, ink as liquid is ejected as ink droplets by vibration of piezoelectric elements (not shown). Four Ink cartridges 22*a* to 22*d* as liquid storage members are detachably mounted on the carriage 14. The ink cartridges 22*a* to 22*d* store four color inks, for example, and ink is supplied to the record head 20 via a tube as a liquid supply passage (not shown). In the embodiment, the four ink cartridges 22*a* to 22*d* are mounted on the carriage 14, but one or more number of ink cartridges may be provided.

On the other hand, a head cleaning mechanism 25 is placed in a non-print area at the right of the frame 12. The head cleaning mechanism 25 has a cap member 26 and a wiping mechanism 27 as wiping member. When the record head 20 moves to the non-print area, the cap member 26 can seal the nozzle openings of the nozzle plate section 21. The cap member 26 is connected to a suction pump 28 and a waste liquid tank (not shown) via a suction tube (not shown). When the inside of the record head 20 is cleaned, the nozzle plate section 21 is sealed with the cap member 26 and is sucked by the suction pump 28, whereby ink, etc., increased in viscosity in the nozzles of the record head 20 is sucked and is collected into the waste liquid tank.

The wiping mechanism 27 is placed at the left of the cap member 26 in FIG. 1, namely, in a print area. The wiping mechanism 27 is formed of a material having high flexibility such as an elastomer. The wiping mechanism 27 can move in a Y direction in FIG. 1 driven by drive section of a wiping mechanism motor (not shown). Thus, when the carriage 14 moves from the print area to the non-print area, the wiping mechanism 27 is placed on this side of the frame 12 (the opposite side to the position where the carriage motor 16 and the timing belt 17 are placed) so as not to abut the record head 20 mounted on the carriage 14. On the other hand, when the carriage 14 moves from the non print area to the print area, the wiping mechanism 27 already moves in the Y direction to a predetermined position at which the wiping mechanism 27 can abut the record head 20, and slides on the nozzle plate section 21 of the moved record head 20. That is, the wiping mechanism 27 does not slide on the record head 20 moving from the print area to the non-print area and slides only on the record head 20 moving from the non-print area to the print area.

Figure 2:
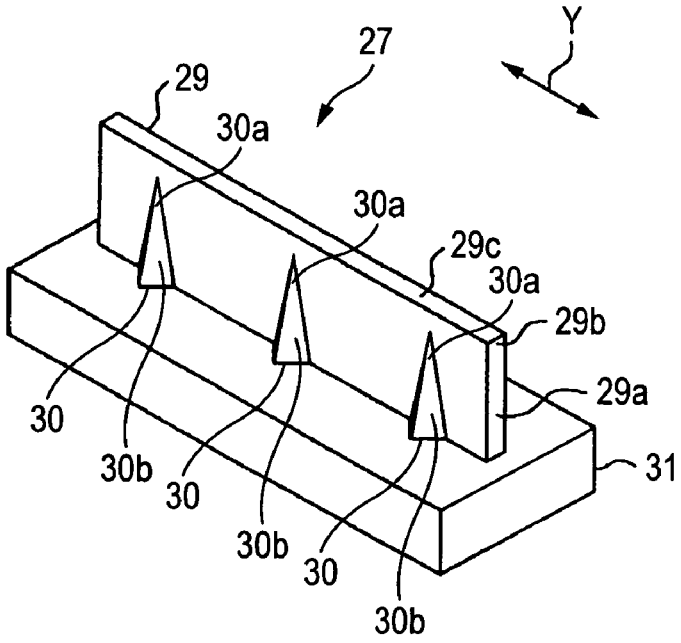
FIG. 2 is a perspective view of a wiping mechanism according to the first embodiment of the invention.

The structure of the wiping mechanism 27 will be discussed with reference to FIG. 2. The wiping mechanism 27 has a fixing plate 31 formed like a plate. A plate-like wiping part 29 is fixed on the top of the fixing plate 31. The wiping part 29 has a body part 29*a* and a tip part 29*b* formed at the vicinity of the tip of the body part 29*a*. The body part 29*a* and support parts 30 are formed of the same material. Three support parts 30 are provided on one side of the wiping part 29, that is, the opposite face to the face where the tip part 29*b* abuts the nozzle plate section 21. The support parts 30 are made of the same material as the wiping part 29 and are shaped each like a triangular pyramid. The wiping mechanism 27 is placed so that the length direction of a top face 29*c* of the wiping part 29 extends in the direction (Y direction in FIG. 1) orthogonal to the move direction of the carriage 14 (X direction). In the described wiping mechanism 27, when the tip part 29*b* (part not supported by the support parts 30) bends, tip parts 30*a* of the support parts 30 also bend accordingly. At this time, body parts 30*b* of parts each having a comparatively large sectional area in the support parts 30 do not bend and support the body part 29*a* of the wiping part 29.

Figure 3:
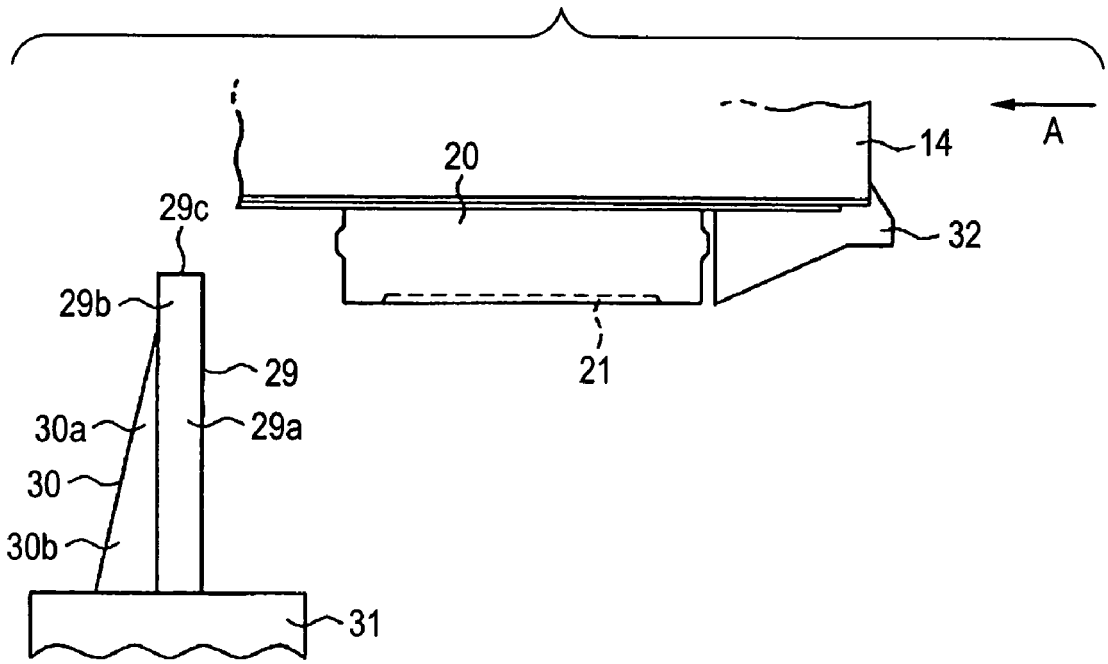
FIG. 3 is a front view of the main part of the wiping mechanism before wiping operation according to the first embodiment of the invention.

As shown in FIG. 3, the wiping part 29 is provided so that the top face 29*c* is placed at a higher position than the lower face of the nozzle plate section 21 of the record head 20. Thus, when the record head 20 moves in the arrow direction A in FIG. 3 and abuts the wiping part 29, the tip part 29*b* of the wiping part 29 bends and is pressed against the lower face of the nozzle plate section 21. An inclined plate 32 is attached to the lower face of the carriage 14. The inclined plate 32 has a slope as the lower face and is inclined as R rises as it is brought away from the record head 20. Thus, as the record head 20 moves in the arrow direction A, the wiping part 29 abuts the nozzle plate section 21 and then abuts the inclined plate 32 and is gradually restored to the former shape along the slope.

Figure 4:
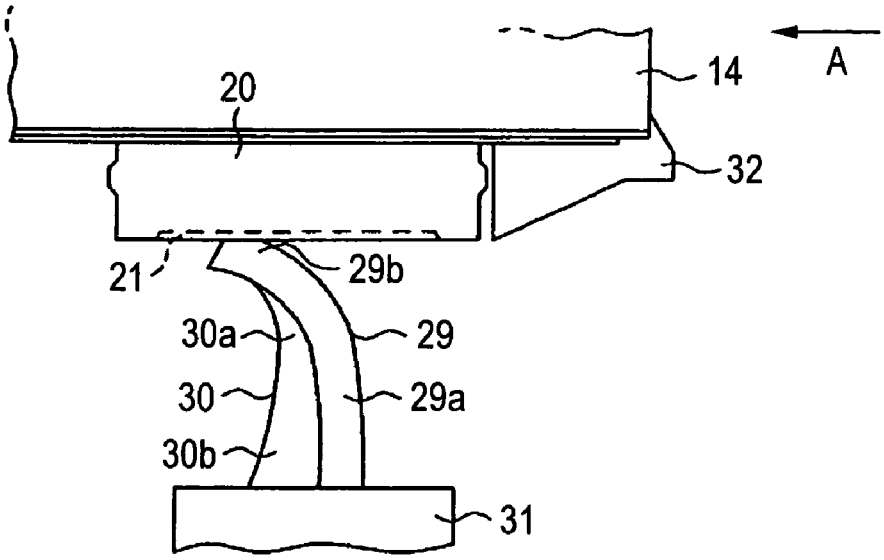
FIG. 4 is a front view of the main part of the wiping mechanism to show the wiping operation according to the first embodiment of the invention.

Next, the operation of the wiping mechanism 27 will be discussed in detail with reference to FIGS. 3 and 4. A power switch (not shown) and a cleaning switch (not shown) are provided on the case of the printer main unit 11. When the user presses the cleaning switch or enters a cleaning execution operation command from a computer connected to the ink jet printer, the cleaning operation is performed in the printer main unit 11. When the cleaning operation is performed, the carriage 14 is placed in the non-print area. The cap member 26 is moved to the record head 20 by a cap move mechanism (not shown) and seals the nozzle plate section 21 of the record head 20. When the nozzle plate section 21 is sealed, operation of the suction pump 28 connected to the cap member 26 is started and ink in the record head 20 is sucked from the nozzle. The sucked ink is collected into the waste liquid tank through the suction tube (not shown) connected to the suction pump 28. When the ink has been sucked, the cap move mechanism operates so as to release the cap member 26 away from the nozzle plate section 21. At this time, ink, etc., that cannot be removed at the negative pressure produced by the suction pump 28 is deposited on the nozzle plate section 21.

A signal is output from controller (not shown) almost at the same time as ink in the record head 20 is sucked. Then, the drive section of the wiping mechanism motor (not shown) is driven, and the wiping mechanism 27 moves in the Y direction in FIG. 1 to a predetermined position at which the wiping mechanism 27 can wipe the nozzle plate section 21. When ink has been sucked and the record head 20 is separate from the cap member 26, the carriage motor 16 is driven for moving the carriage 14 in the arrow direction A in FIGS. 3 and 4, namely, to the print area. When the record head 20 moves to the wiping mechanism 27 placed at the predetermined position, the wiping part 29 abuts the nozzle plate section 21 of the record head 20 as shown in FIG. 4. Pressure for pressing the wiping part 29 in the arrow direction A (X direction), namely, against the support parts 30 acts on the wiping part 29. At this time, since the tip part 30*a* of each support part 30 is formed narrow, the stress of the tip part 30*a* to the pressure is small. Thus, the tip part 29*b* of the wiping part 29 bends in the direction of the pressure together with the tip parts 30*a* of the support parts 30. Also, since the body part 30*b* of each support part 30 is formed thick, a comparatively large stress is produced in the opposite direction to the pressure the opposite direction to the arrow direction. A in FIG. 4). Therefore, the tip part 29*b* of the wiping part 29 is pressed against the nozzle plate section 21 by the stress. Thus, when the tip part 29*b* is formed of a material having high flexibility to provide adhesion properties to the nozzle plate section 21, the pressure for pressing the tip part 29*b* of the wiping part 29 against the nozzle plate section 21 can be increased. Since the body part 29*a* of the wiping part 29 is supported by the body parts 30*b* of the support parts 30, the body part 29*a* of the wiping part 29 scarcely bends.

Thus, the carriage 14 continues to move in a state in which the tip part 29*b* bends mainly in the wiping part 29. While bending, the tip part 29*b* of the wiping part 29 slides on the nozzle plate section 21 so as to wipe the ink deposited on the nozzle plate section 21. The ink wiped by the wiping part 29 drops along the side of the wiping part 29 to the lower part of the wiping mechanism 27. After the operation of wiping the nozzle plate section 21, the wiping part 29 slides on the lower face of the inclined plate 32. Thus, the wiping mechanism 27 is gradually restored from the warpage state to the former shape (shape when external force is not applied). Therefore, the wiping mechanism 27 is not rapidly restored to the former shape and thus the ink deposited on the wiping part 29 is not scattered to the surroundings.

When the wiping mechanism 27 is separated from the record head 20, the wiping mechanism 27 is moved in the Y direction in FIG. 1 by the drive section of the wiping mechanism motor (not shown) so that the wiping mechanism 27 is brought away from the predetermined position to wipe the nozzle plate section 21.

The ink jet printer of the embodiment can provide the following advantages.

(1) In the first embodiment, the wiping mechanism 27 for wiping the nozzle plate section 21 of the record head 20 has the body part 29*a*, the tip part 29*b* being formed in the vicinity of the tip of the body part 29*a* for abutting the record head 20, and the support parts 30 for supporting the body part 29*a*. Accordingly, the tip part 29*b* of the wiping part 29 is supported by the support parts 30 and thus can be pressed against the record head 20 at a comparatively strong press pressure. Therefore, the ink deposited on the nozzle plate section 21 can be wiped clean. Since the support parts 30 support the body part 29*a* of the wiping part 29, deformation of and damage to the wiping part 29 can be prevented as much as possible.

(2) In the first embodiment, each support part 30 is formed so that the sectional area parallel with the bottom becomes smaller toward the tip from the bottom, namely, tapers. Since the body part 30*b* of each support part 30 is formed thick, when pressure for bending the wiping part 29 to the support part side acts, a comparatively large stress is produced in the opposite direction to the pressure in the body part 30*b*. Therefore, the stress can cause the tip part 29*b* of the wiping part 29 to be pressed against the nozzle plate section 21 at a comparatively large press pressure. Since the tip part 30*a* of each support part 30 is formed narrow, when pressure for bending the wiping part 29 to the support part 30 side acts, a bend occurs in the direction of the pressure together with the tip part 29*b* of the wiping part 29. Thus, when the tip part 29*b* of the wiping part 29 abuts the nozzle plate section 21, the tip part 29*b* bends matching the shape of the nozzle plate section 21 and can come in intimate contact with the nozzle plate section 21. Therefore, if the wiping part 29 is formed of a material having high flexibility to enhance adhesion properties to the nozzle plate section 21, the pressure for pressing the tip part 29*b* of the wiping part 29 against the nozzle plate section 21 can be increased. Thus, the ink deposited on the nozzle plate section 21 can be wiped clean.

(3) In the embodiment, the support parts 30 are provided on one side of the wiping part 29, that is, the opposite face to the face where the tip part 29*b* abuts the record head 20. Thus, the support parts 30 can support the wiping part 29 from the opposite side to the abutment face against the record head 20. Therefore, the wiping part 29 can be supported more effectively.

(4) In the embodiment, the support parts 30 are formed of the same material as the wiping part 29. Thus, manufacturing is facilitated and the cost can be reduced.

(5) In the embodiment, three support parts 30 are provided. Thus, the wiping part 29 can be supported effectively with a comparatively small number of parts.

Second Embodiment

A second embodiment of the invention will be discussed with reference to FIGS. 5 and 6. The second embodiment differs from the first embodiment only in the structure of wiping mechanism and therefore similar parts will not be discussed again in detail.

Figure 5:
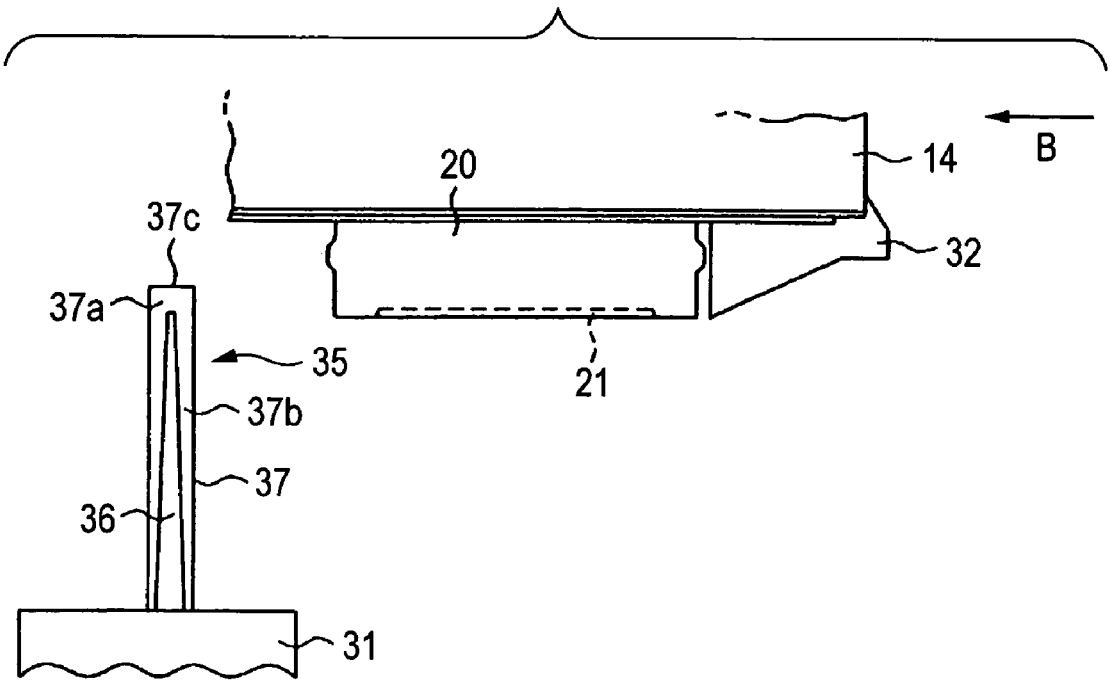
FIG. 5 is a front view of the main part of a wiping mechanism before wiping operation according to a second embodiment of the invention.
Figure 6:
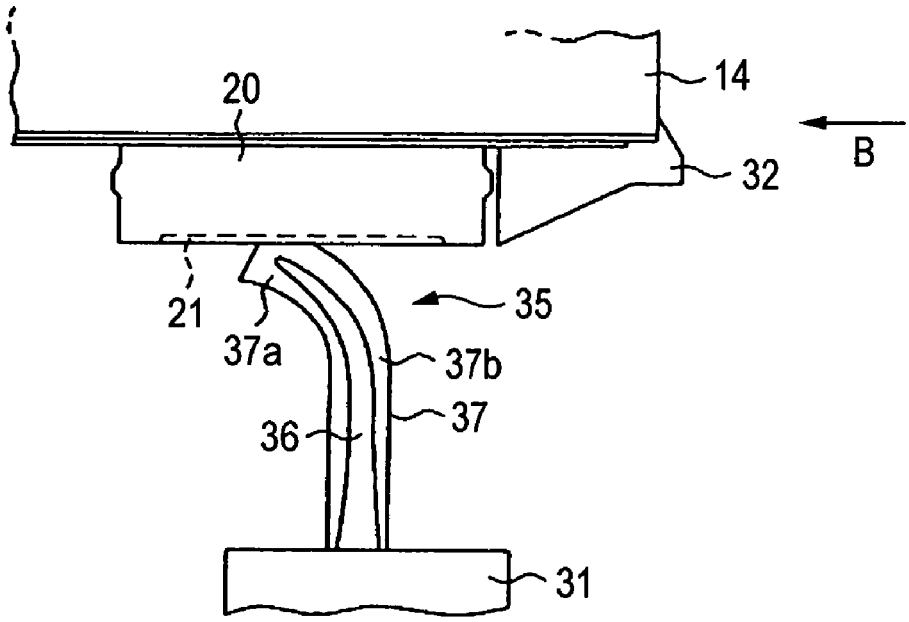
FIG. 6 is a front view of the main part of the wiping mechanism to show the wiping operation according to the second embodiment of the invention.

As shown in FIGS. 5 and 6, a wiping mechanism 35 includes a plate-like wiping part 37 containing a support part 36. The wiping part 37 is formed of a material having high flexibility such as an elastomer. The support part 36 is made of an elastomer, etc., having a larger elastic coefficient than the wiping part 37. The support part 36 is shaped like a triangle pole and is provided so that one side of quadrangles of the triangle pole becomes the bottom of the support part 36. Therefore, the sectional area parallel with the bottom is increased toward the bottom of the support part 36, so that the wiping mechanism 35 increases in elastic coefficient as it is toward the bottom of the support part 36.

When a carriage 14 moves in the arrow direction B in FIGS. 5 and 6, a nozzle plate section 21 of a record head 20 abuts the wiping part 37 moved to a predetermined position. At this time, a tip part 37*a* of the wiping part 37 bends in the arrow direction B because of a small stress. At this time, a body part 37*b* of the wiping part 37 is supported by the support part 36 and thus stress is comparatively large. Therefore, the body part 37*b* scarcely bends and produces pressure for pressing the tip part 37*a* against the nozzle plate section 21. Thus, the tip part 37*a* of the wiping part 37 slides on the nozzle plate section 21 while the tip part 37*a* of the wiping part 37 is pressed against the nozzle plate section 21 of the record head 20.

Therefore, according to the second embodiment, the following advantages can be provided in addition to advantages (1) and (2) described above in the first embodiment:

(6) In the second embodiment, the support part 36 having a elastic coefficient larger then that of the wiping part 37 is formed inside the wiping part 37. Thus, the tip part 37*a* can be pressed against the nozzle plate section 21 at a larger press pressure.

(7) In the second embodiment, the support part 36 is formed inside the wiping part 37. Thus, the wiping part 37 can be supported by the support part 36 from the inside of the wiping part 37. The wiping mechanism 35 can be made smaller than that with the support part 36 placed outside the wiping part 37.

The first and second embodiments may be modified as follows:

In the embodiments, the record head 20 is moved together with the carriage 14 to the wiping mechanism 27, 35 with standing still at the predetermined position, whereby the nozzle plate section 21 is wiped by the wiping part 29, 37. In addition, the wiping mechanism 27, 35 may be moved to the record head 20 with standing still, whereby the wiping part 29, 37 may be slid on the nozzle plate section 21 for wiping the nozzle plate section 21.

In the embodiments, when the record head 20 is cleaned, the wiping mechanism 27, 35 is moved to the predetermined position where the nozzle plate section 21 is wiped. However, the wiping mechanism 27, 35 may always be fixed to the predetermined position where the nozzle plate section 21 is wiped.

In the embodiments, the wiping mechanism 27, 35 is placed so that the length direction of the top face 29*c*, 37*c* of the wiping part 29, 37 extends parallel with the direction (the Y direction in FIG. 1) orthogonal to the move direction of the carriage 14 (the X direction in FIG. 1). In addition, the wiping mechanism 27, 35 may be placed so that the length direction of the top face 29*c*, 37*c* extends in a direction slanting with respect to the X direction.

In the embodiments, the wiping part 29, 37 is shaped in a plate, but may be formed so as to taper, that is, the wiping part 29, 37 becomes gradually narrow toward its tip.

In the embodiments, the "vicinity of the tip" where the wiping part 29, 37 abuts the record head 20 is correspond to the tip part 29*b*, 37*a*. However, the "vicinity of the tip" may be correspond to a portion abutting the record head 20. Therefore, the top face 29*c*, 37*c* and the body part 29*a*, 37*b* can also be included.

In the first embodiment, the wiping part 29 and the support parts 30 are formed of the same material, but the support parts 30 may be formed of a material having a larger elastic coefficient than the wiping part 29. In this configuration, the wiping part 29 can be pressed against the record head 20 and can be brought into intimate contact therewith at a larger press pressure.

In the first embodiment the wiping part 29 and the support parts 30 are formed as separate members, but may be formed in one piece. In this configuration, the manufacturing step of the wiping mechanism can be facilitated.

Figure 7:
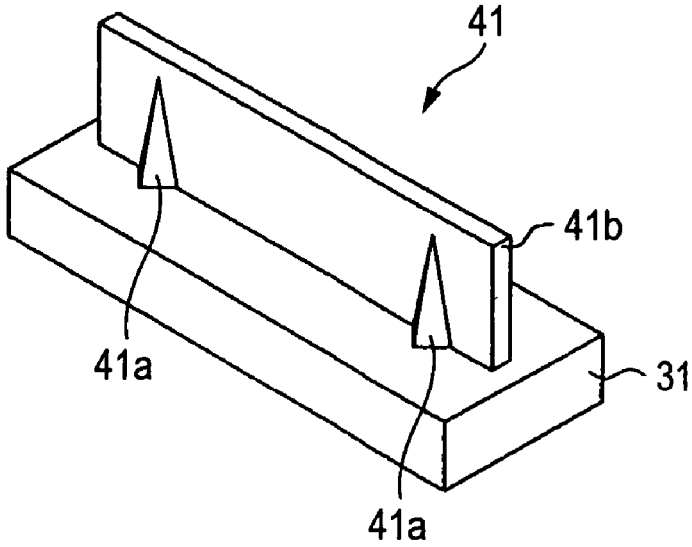
FIG. 7 is a perspective view of another example of a wiping mechanism.
Figure 8:
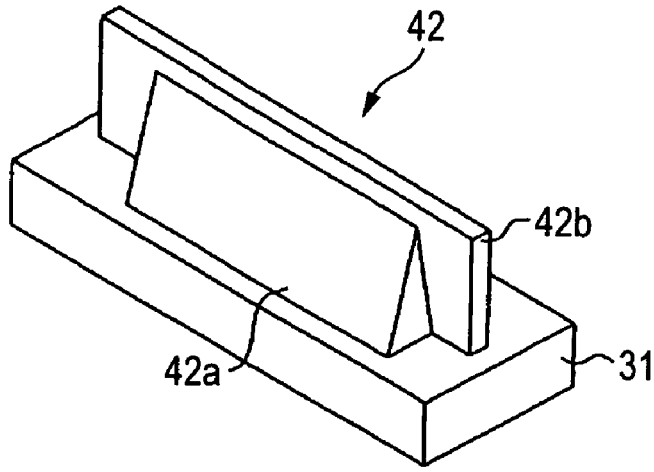
FIG. 8 is a perspective view of another example of a wiping mechanism.
Figure 9:
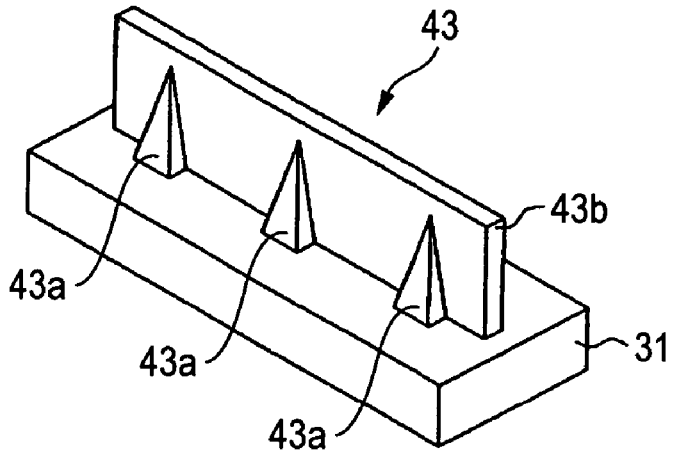
FIG. 9 is a perspective view of another example of a wiping mechanism.
Figure 10:
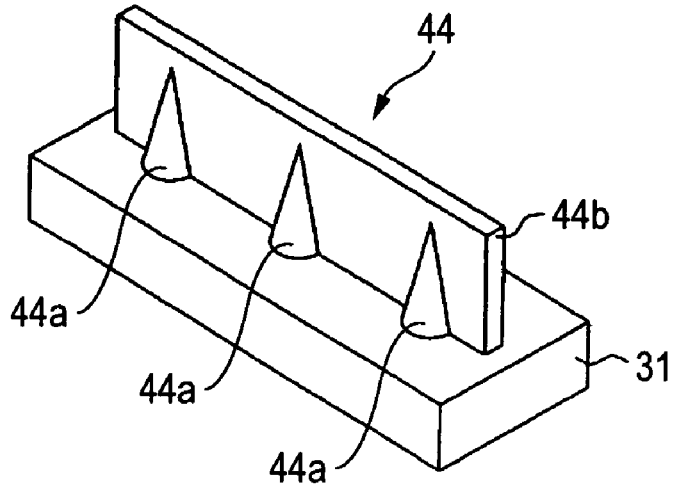
FIG. 10 is a perspective view of another example of a wiping mechanism

In the first embodiment, the three support parts 30 each shaped like a triangular pyramid are provided, but one or more number of support members may be provided. In addition, a support part of any other shape may be provided. Two support parts 41*a* may be provided for one wiping part 41*b*, for example, as shown in FIG. 7. Only one support part 42*a* shaped like a triangle pole throughout the roughly full length of a wiping part 42*b* in the width direction thereof may be provided, as shown in FIG. 8. A support part 43*a* shaped like a rectangular pyramid shown in FIG. 9 and a support part 44*a* shaped like a cone as shown in FIG. 10 may be provided. The shapes or the number of the support parts is thus changed, whereby the pressure for pressing the wiping part against the nozzle plate section 21 of the record head 20 can be changed.

In the second embodiment, the support part 30 is shaped like a triangle pole, but may be shaped like a pyramid such as a cone or a triangular pyramid such that the sectional area parallel with the horizontal plane becomes smaller toward the tip.

In the second embodiment, the support part 36 contained in the wiping part 37 is formed of an elastomer, etc. In addition, the support part 36 may be formed of metal or plastic.

In the embodiments, the liquid ejecting apparatus is used as the ink jet printer, but may be applied as a liquid ejecting apparatus for ejecting any other liquid than ink. For example, the liquid ejecting apparatus may be a liquid ejecting apparatus for ejecting liquid of an electrode material, a color material, etc., used for manufacturing a liquid crystal display, an EL display, an FED (surface light emission display), etc., a liquid ejecting apparatus for ejecting a biological organic substance used for manufacturing a biochip, or a specimen ejecting apparatus as a precision pipette.

What is claimed is:

1. A liquid ejecting apparatus, comprising: a carriage, reciprocating;

a liquid ejecting head, mounted on the carriage, and having a nozzle forming face from which liquid is ejected; and a wiping member, wiping the nozzle forming face in accordance with a movement of the carriage, wherein the wiping member includes:

a body part;

a wiping part, formed at a tip of the body part for abutting the liquid ejecting head; and a plurality of support parts, supporting the body part; and wherein the support parts are provided on a face of the wiping part that is opposite to a wiping face of the wiping part which the liquid ejecting head abuts.

2. The liquid ejecting apparatus as set forth in claim 1, wherein the support parts are formed such that a sectional area of each of the support parts parallel with a bottom face of each of the support parts becomes smaller toward the tip from the bottom face.

3. The liquid ejecting apparatus as set forth in claim 1, wherein the support parts have an elastic coefficient larger than that of the wiping part.

4. The liquid ejecting apparatus as set forth in claim 1, wherein the support parts have the same elastic coefficient as that of the wiping part.

5. The liquid ejecting apparatus as set forth in claim 1, wherein the support parts have cone shapes.

6. The liquid ejecting apparatus as set forth in claim 1, wherein the support parts have pyramid shapes.

7. The liquid ejecting apparatus as set forth in claim 1, wherein the support parts have triangular pole shapes.

8. A liquid ejecting apparatus, comprising:

a carriage, reciprocating;

a liquid ejecting head, mounted on the carriage, and having a nozzle forming face from which liquid is ejected; and a wiping member, wiping the nozzle forming face in accordance with a movement of the carriage, wherein the wiping member includes:

a body part;

a wiping part, formed at a tip of the body part for abutting the liquid ejecting head; and a support part, supporting the body part; and wherein the support part is formed such that a sectional area of the support part parallel with a bottom face of the support part becomes smaller toward the tip from the bottom face.

9. The liquid ejecting apparatus as set forth in claim 8, wherein the support part is provided on a side face of the wiping part.

10. The liquid ejecting apparatus as set forth in claim 9, wherein the side face of the wiping part is a face opposite to the face which the liquid ejecting head abuts.

11. The liquid ejecting apparatus as set forth in claim 8, wherein the support part has an elastic coefficient larger than that of the wiping part.

12. The liquid ejecting apparatus as set forth in claim 8, wherein the support part has the same elastic coefficient as that of the wiping part.

13. The liquid ejecting apparatus as set forth in claim 8, wherein the support part has a cone shape.

14. The liquid ejecting apparatus as set forth in claim 8, wherein the support part has a pyramid shape.

15. The liquid ejecting apparatus as set forth in claim 8, wherein the support part has a triangular pole shape.

16. The liquid ejecting apparatus as set forth in claim 8, wherein the support part is a plurality of support parts.

* * * * *